United States Patent [19]

Mima

[11] 4,439,978

[45] Apr. 3, 1984

[54] APPARATUS FOR SPLICING SPUN YARNS

[75] Inventor: Hiroshi Mima, Kyoto, Japan

[73] Assignee: Murata Kikai Kabushiki Kaisha, Kyoto, Japan

[21] Appl. No.: 414,306

[22] Filed: Sep. 2, 1982

[30] Foreign Application Priority Data

Sep. 3, 1981 [JP] Japan ..... 56-139099

[51] Int. Cl.[3] ..... D01H 15/00

[52] U.S. Cl. ..... 57/22; 57/261

[58] Field of Search ..... 57/22, 261, 304, 305; 242/35.5 R, 147 A

[56] References Cited

U.S. PATENT DOCUMENTS 4,263,775 4/1981 Mima ..... 57/261 X 4,322,943 4/1982 Rohner ..... 57/22 X 4,356,688 11/1982 Zurcher ..... 57/22

*Primary Examiner*—Donald Watkins

*Attorney, Agent, or Firm*—Spensley, Horn, Jubas & Lubitz

[57] ABSTRACT

A pneumatic splicing apparatus for spun yarns comprising a splicing member having a splicing hole and a jet nozzle for jetting a compressed fluid into the splicing hole, control nozzles arranged on both the outer sides of the splicing hole to suck and to untwist the yarn ends, cutting devices for cutting the yarn ends, and yarn guiding means for inserting the yarn ends into the splicing hole. The control nozzles provides with a cylindrical sleeve slidably fitted in the nozzle hole thereof to change the position of a jet hole of the control nozzle relative to the yarn ends to be untwisted.

3 Claims, 15 Drawing Figures

FIG. 9-a
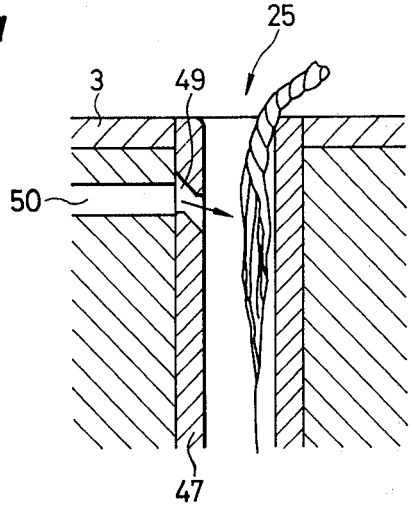
FIG. 9-b
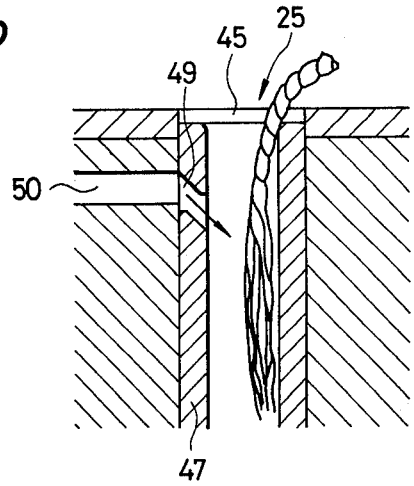
FIG. 9-c
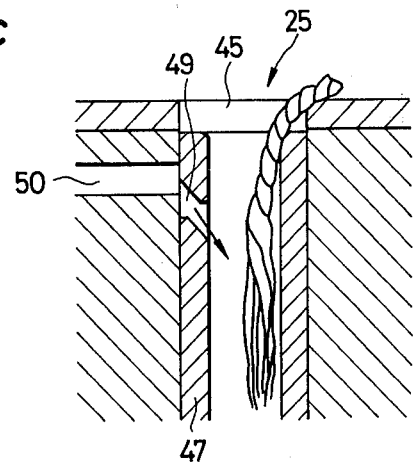

APPARATUS FOR SPLICING SPUN YARNS

BACKGROUND OF THE INVENTION

The present invention relates to an apparatus for splicing spun yarns. An inventor of the present application has invented and proposed a pneumatic yarn splicing apparatus, in which a splicing member having a splicing hole and a jet nozzle for jetting a compressed fluid into the splicing hole are provided and control nozzles are arranged on both the outer sides of the splicing hole to suck and to untwist the yarn ends to be spliced. (See, an example, Japanese Patent Application Number 134986/80 and U.S. patent application Ser. No. 360,062 claiming priority of Japanese Patent Application Number 44967/81 filed Mar. 26, 1981.)

BRIEF DESCRIPTION OF THE DRAWINGS

FIGS. 9-*a*, 9-*b* and 9-*c* are enlarged sectional views of the control nozzle.

DETAILED DESCRIPTION OF THE INVENTION

Figure 1:
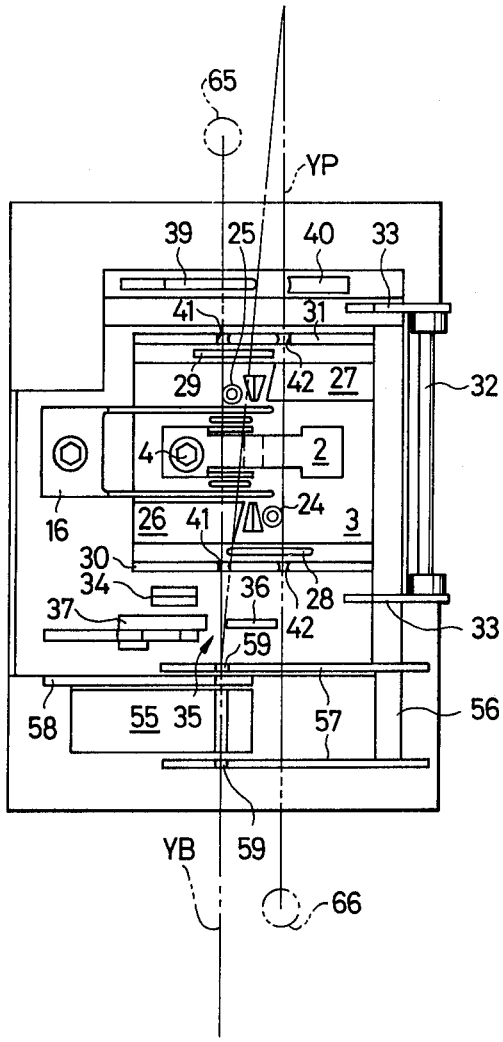
FIG. 1 is a front view of the splicing apparatus.

The present invention more particularly relates to an improved apparatus of the yarn splicing apparatus as mentioned above.

It is a primary object of the present invention to provide a splicing apparatus in which deterioration of the appearance of the spliced portion formed by the splicing operation, which is due to decrease of the size or strength in the spliced portion or to formation of pills, is effectively prevented. The present invention is characterized in that in each of control nozzle holes sucking and holding yarn ends before the splicing operation, the position for jetting fluid stream to the yarn end for untwisting the yarn end portion can be changed so that the length of the untwisted portion of the yarn ends may be determined appropriately.

The apparatus of the present invention will now be described in detail with reference to the accompanying drawings.

Substantially at the center of the splicing apparatus 1 of the present invention, a splicing member 2 is secured to a bracket 3 through a screw 4, and a cylindrical splicing hole 5 is formed at the center of the splicing member 2. A slit 6 suitable for inserting a yarn Y from the outside is formed on the splicing hole 5 along the entire tangential direction thereof, and a jet nozzle 7 opened tangentially to the splicing hole 5 is formed on the splicing member 2. The splicing member 2 further includes control plates 12 and 13 secured through spacers 10 and 11 to wall faces 8 and 9 on the both open sides of the splicing hole 5, and one side edges 14 and 15 of the control plates 12 and 13 are located so that they intersect a part of the opening of the splicing hole 5.

The control plates 12 and 13, together with yarn pressing levers 16 described hereinafter, exert a function of positioning a yarn end YP on the package side and a yarn end YB on the bobbin side, inserted in the splicing hole 5, so that first entanglement of the two yarn ends is guaranteed, and the control plates 12 and 13 control the quantity of air flowing out from both the end openings of the splicing hole 5 to prevent flying-out of the yarn ends YP and YB. Moreover, the control plates 12 and 13 exert a function of forming a joint having a good appearance by an appropriate turning stream. The spacers 10 and 11 prevent flying-out of the yarn ends YP and YB from the slit 6, which is caused by increase of the quantity of compressed fluid flowing out in the direction of the slit 6 after impingement against the walls of the control plates 12 and 13. Namely, the spacers 10 and 11 forms spaces between the wall faces 8 and 9 of the splicing member 2 and the control plate 12 and 13 to control the quantity of the fluid flowing out from the slit 6. Incidentally, the fluid is supplied to the jet nozzle hole 7 through a conduit 17 connected to a pressure source not shown in the drawings. A pair of above-mentioned upper and lower yarn pressing levers 16 are pivoted on the bracket 3 through a supporting shaft 18.

In the vicinity of the control plates 12 and 13 of the splicing member 2, there are arranged in sequence yarn guide pins 20 and 21, yarn pressing levers 16, control nozzles 24 and 25, yarn guides 26 and 27, cutters 28 and 29 and fork guides 30 and 31 on both sides of the openings of the splicing hole 5 of the splicing member 2 so that the openings of the splicing hole 5 are interposed between the respective paired members. A pair of yarn gathering levers 33 are turnably secured to the upper and lower portions of a supporting shaft 32 on the side portion of the splicing member 2. Reference numeral 34 represents a stopper of the yarn gathering lever 33 and reference numeral 35 represents a clamping device for the yarn end YB on the bobbin side, which comprises a turning lever 36 and a stopper 37. Reference numeral 36 represents a clamping device for the yarn end YP on the package side, which comprises a turning lever 39 and a stopper 40.

The control nozzles 24 and 25 have the same shape. Accordingly, one of them, that is, the control nozzle 25, will now be described. A nozzle hole 45 is formed to pierce through the bracket 3 and a block 46 integrated therewith, and a tubular sleeve 47 is fitted in the nozzle hole 45 slidably in the axial direction of the nozzle hole 45. The sleeve 47 is connected to a flexible pipe 48 connected to a suction pipe not shown in the drawings. A jet hole 49 is slantly formed in the vicinity of the open end of the tubular sleeve 47 to extend to the interior of the sleeve 47. The jet hole 49 is communicated with a pressure conduit not shown in the drawings through an air introducing hole 50 formed on the block 46.

Below the clamping device 35, a detecting device 55 is arranged, and a pair of turning guide plates 57 supported on a turning shaft 56 are arranged so that the detecting device 55 is interposed between the paired guide plates 57. A stationary guide plate 58 is arranged between the turning guide plate 57 and the detecting device 55. On each of said paired turning guide plates 57 is formed an escape groove 60 communicated with a guide groove 59. The guide groove 59 is located at such a position that the yarn contained in the guide groove 59 is allowed to pass through the detecting device 55.

The operations of the apparatus of the present invention will now be described.

When the detecting device 55 for detecting yarn breakage or running out of the yarn or the bobbin during the rewinding operation detects stopping of running of the yarn, the winding drum comes to stop and the splicing operation is performed. A pair of a suction arm, a suction arm 66 on the package side and a suction arm 65 on the bobbin side, suck the yarn end YP on the package side and the yarn end YB on the bobbin side, respectively, and turn to introduce the yarn ends into the splicing apparatus 1.

The paired suction arms 66 and 65 are not simultaneously turned, but the yarn end YP on the package side is first sucked by the suction arm 66 on the package side and the arm 66 is turned and shifted to the one outside position of the splicing apparatus 1 and stopped there. After the passage of a predetermined time, the yarn end YB on the bobbin side is sucked by the suction arm 65 on the bobbin side, and the suction arm 65 is turned and shifted to the another outside position of the splicing apparatus 1 and stopped there.

Figure 3:
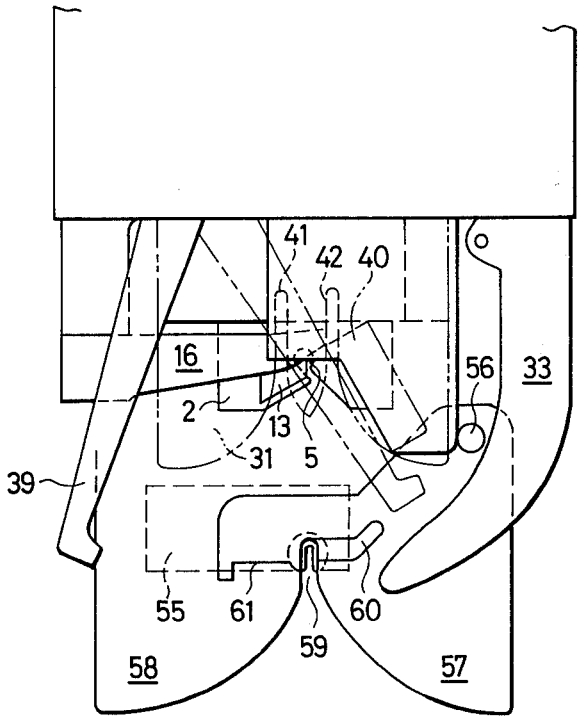
FIGS. 3 and 4 are plan views of the splicing apparatus.
Figure 4:
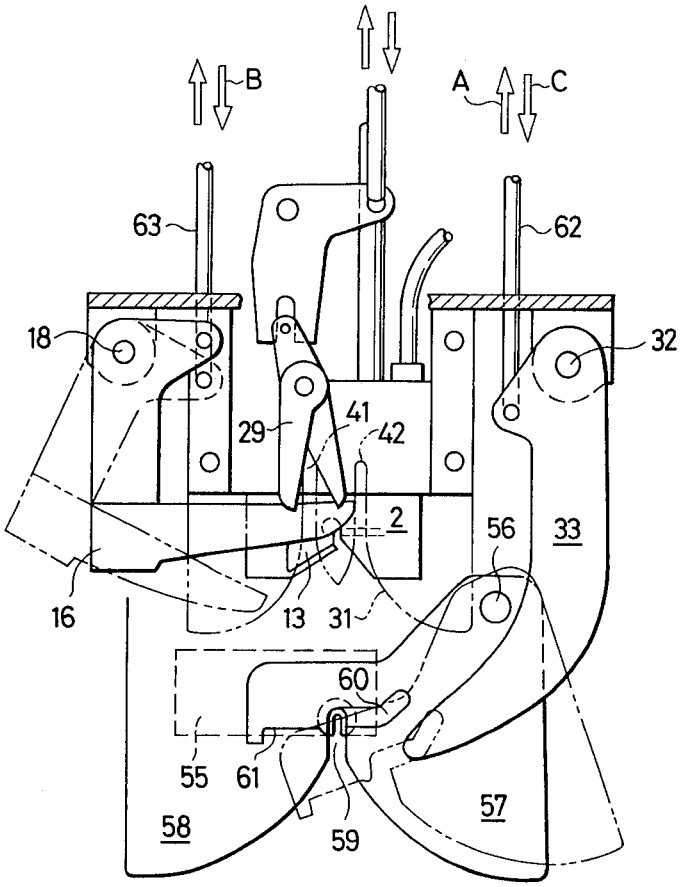
Figure 5:
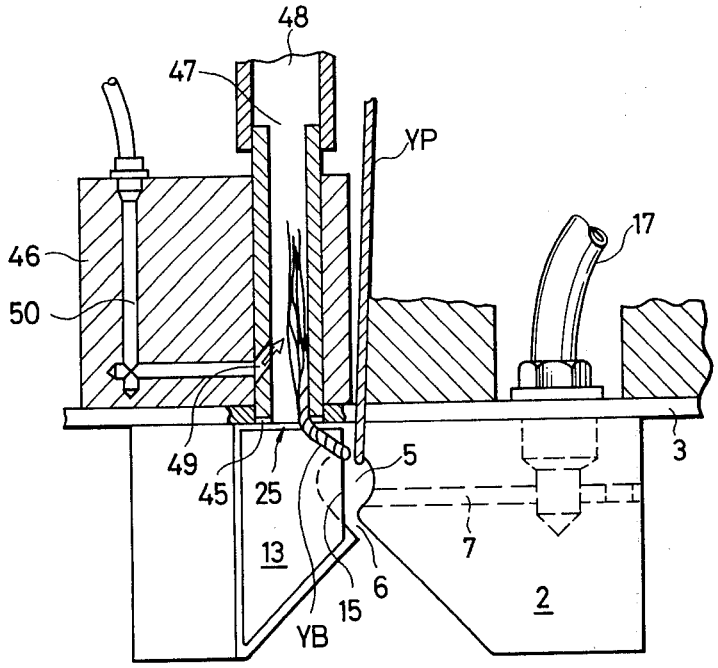
FIGS. 5 through 7 are plan views of the splicing member.
Figure 6:
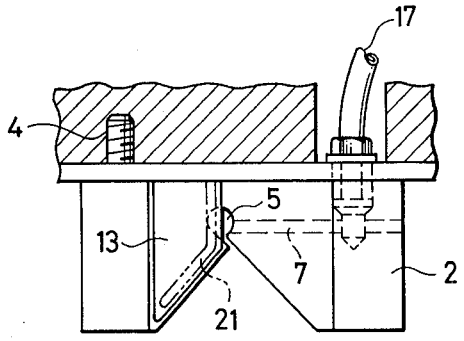
Figure 7:
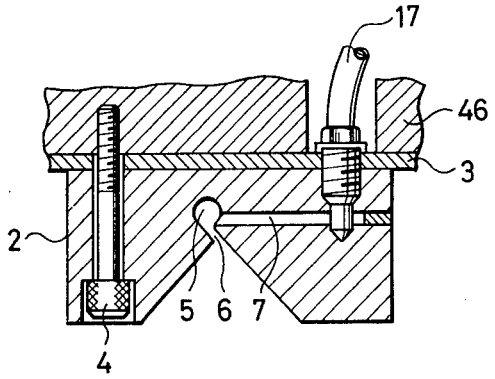
Figure 8:
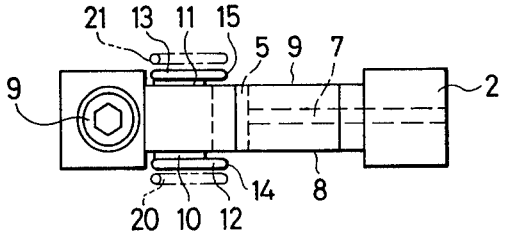
FIG. 8 is a front view of the splicing member.

During the predetermined period of from the point of initiation of the operation of the suction arm 66 on the package side to the point of initiation of the operation of the suction arm 65 on the bobbin side, as shown in FIGS. 3 and 4, the turning lever 39 of the clamping device 38 on the package side is actuated to hold the yarn YP between the turning lever 39 and the stopper 40 and to introduce the yarn YP into the guide grooves 59 of the turning guide plate 57 and stationary guide plate 58 arranged in the vicinity of the detecting device 55. After checking is performed by the detecting device, the turning guide plate 57 is turned to a position indicated by a chain line in FIG. 4 with the turning shaft 56 being as the fulcrum to separate the yarn YP from the splicing apparatus 1 and insert the yarn YP into the escape groove 60.

Then, the suction arm 65 on the bobbin side sucks the yarn YB on the bobbin side, and the suction arm 65 is turned and shifted to the outside position of the splicing apparatus 1 and stopped there. At this time, the yarn YB is passed through a hook portion 61 of the turning guide plate 57 and as shown in FIG. 2, the yarn YB is held between the stopper 37 of the clamping device 35 on the bobbin side and the turning lever 36.

When the above-mentioned operations of the suction arms 65 and 66 on both the bobbin and package sides are completed, the yarn gathering levers 33 are turned with the supporting shaft 32 being as the fulcrum, and both the yarns YB and YP are guided to the guide grooves 41 and 42 of the fork guides 30 and 31, respectively, and inserted into the splicing hole 5 of the splicing member 2 through the slit 6.

Figure 2:
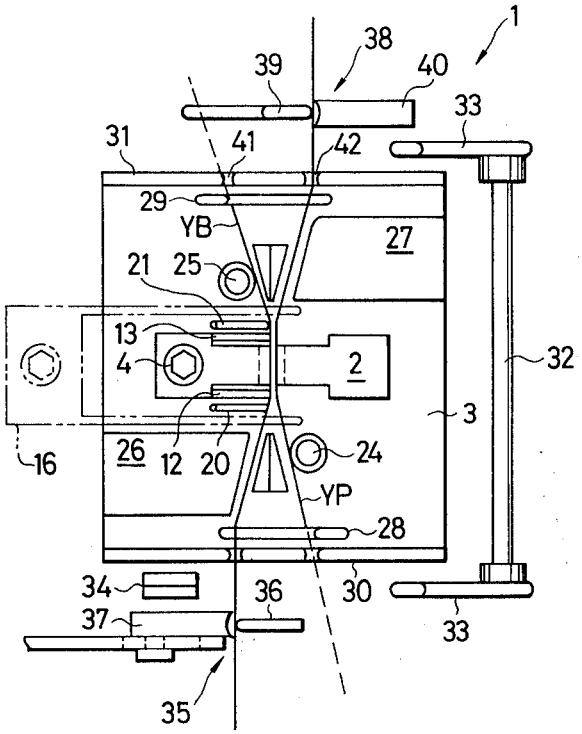
FIG. 2 is a partially omitted front view of the splicing apparatus.

Then, the yarn cutting operation is performed by the cutters 28 and 29 at positions apart by predetermined distances from the clamping device 35 on the bobbin side and the clamping device 38 on the package side, as shown in FIG. 2. The yarn cutting positions have a relation to the length of the joint formed by splicing and have influences on the appearance, touch and binding strength of the joint formed by splicing. The yarn cutting positions are changed according to the count number of the yarn.

Figure 10:
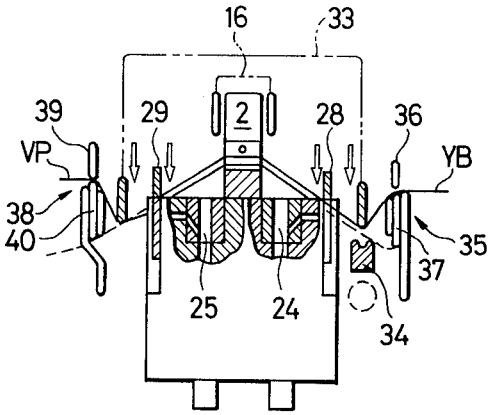
FIGS. 10 through 12 are diagrams illustrating the splicing operation steps in the splicing apparatus.

Referring to FIG. 10, both the yarns YB and YP are held by the clamping devices 35 and 38, and the yarn gathering lever 33 is actuated to move a rod 62 shown in FIG. 4 in a direction of arrow A by a control cam not shown in the drawings and the yarn gathering lever 33 is turned in the clockwise direction with the shaft 32 being as the fulcrum. In this state, the yarn cutting operation is performed. Incidentally, when the yarn gathering lever 33 and the cutters 28 and 29 are operated, the yarn pressing lever 16 is disposed in the state where the yarn pressing lever 16 is turned in the clockwise direction with the shaft 18 being as the fulcrum by the operation (in a direction of arrow B) of a rod 63 as shown in FIG. 4.

Figure 11:
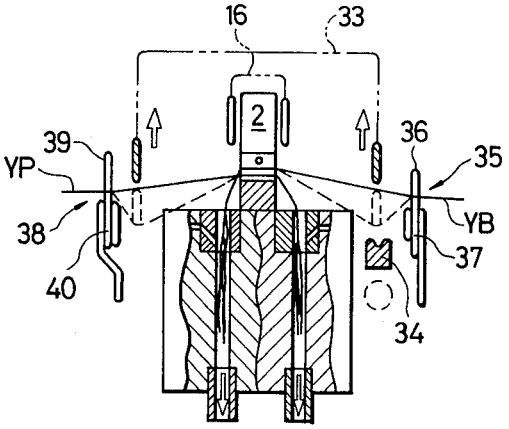

Then, as shown in FIG. 11, the yarn ends YB and YP are sucked by the control nozzles 24 and 25, and simultaneously or before or after this sucking operation, the yarn gathering lever 33 is turned in a direction separating from the yarn, that is, in the counterclockwise direction with the shaft 32 being as the fulcrum by the operation (in a direction of arrow C) of the rod 62, as shown in FIG. 4 and the lever 33 separates from the yarn Y. At this time, the yarn ends YB and YP are sucked in the control nozzle 25 by the suction force of the sleeve 47 connected through the flexible pipe 48, and simultaneously, the yarn ends YB and YP are untwisted in a state suitable for splicing by compressed fluid jetted from the jet hole 49 of the sleeve 47 through the air introducing hole 50.

Since the sleeve 47 having the jet hole 49 formed thereon is inserted in the nozzle hole 45 so that it can advance and retreat in the nozzle hole 45 as shown in FIGS. 9-*a*, 9-*b* and 9-*c*, the untwisting length and untwisting degree in the yarn ends are changed according to the advance or retreat position of the sleeve 47. Supposing that the normal untwisting state is illustrated in FIG. 9-*b*, if the sleeve 47 is inserted in a rather drawn-out state as shown in FIG. 9-*a*, the jet hole 49 and nozzle hole 45 are brought to closer to each other and the jetted fluid impinges against the relatively upper portions of the yarn ends YP and YB, with the result that the untwisting length is increased and the size of the top portion is decreased by detachment of fibers. If splicing is carried out in this state, the appearance of the joint is degraded and pilling is readily caused. If the sleeve is advanced into the deep interior of the nozzle hole 45 as shown in FIG. 9-*c*, the position of the jet hole 49 is greatly deviated from the position of the nozzle hole 45 and the jetted fluid impinges against the tops of the yarn ends YP and YB, with the result that the untwisting length is shortened and the size or strength of the formed joint is reduced. Therefore, the insertion depth of the sleeve 47 is adjusted according to the kind and count number of the yarn so that an appropriate untwisting state is produced.

The top portions of the top-free yarns YB and YP inserted in the sleeve 47 are untwisted by the compressed fluid jetted from the jet hole 49, but since there are two kinds of twists Z and S on the yarn ends YB and YP and the twisting directions of these twists are opposite to each other, the jetting direction of the jet hole 49 should be adjusted according to the twisting direction of the yarn Y. More specifically, in case of an S-twist yarn, the fluid jetted from the jet hole 49 should be turned in the clockwise direction and in case of a Z-twist yarn, the fluid jetted from the jet hole 49 should be turned in the counterclockwise direction.

It is preferred that the suction operation by the control nozzles 24 and 25 be started just before the yarn is cut by the cutters 28 and 29. More specifically, when the yarns YB and YP are cut, a tension is sometimes given to the yarns YB and YP by the sucking action of the suction arms 65 and 66 on both the bobbin and package sides, and therefore, it sometimes happens that the yarn ends YB and YP are scattered on cutting and they separate from the control nozzles 24 and 25 and are not sucked by the control nozzles 24 and 25. Accordingly, it is preferred that the sucking operation by the control nozzles 24 and 25 be started just before the yarn is cut, although it is permissible in principle that the sucking operation is started simultaneously with or subsequently to the yarn cutting operation. Incidentally, the fluid is supplied to the control nozzles 24 and 25 by changing over valves by a solenoid not shown in the drawings.

Figure 12:
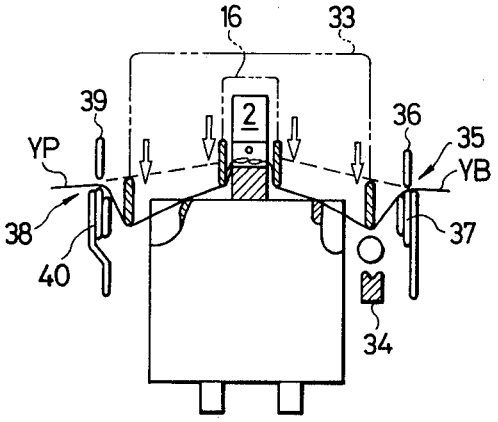

When the yarn ends YB and YP are untwisted in a state suitable for splicing by the control nozzles 24 and 25 and the sucking operation by the control nozzles 24 and 25 is stopped, simultaneously or subsequently, as shown in FIG. 12, the yarn gathering levers 33 are operated to guide the yarn ends YB and YP, respectively, and one lever 33 is turned to the position impinging against the stopper 34. Simultaneously, the yarn pressing levers 16 are operated to similarly guide the yarn ends YB and YP, and the yarn ends YB and YP are held by one lever 16, that is, the lever 16 on the side where the yarn Y is untwisted by the compressed fluid jetted from the jet nozzle 7 of the splicing member 2, to such an extent that untwisting of the yarn ends YB and YP is inhibited. On the other fork side, the compressed fluid exerts a function of twisting the yarn ends YB and YP, and therefore, the other lever on the fork side need not particularly hold the yarn ends YB and YP but it is sufficient if this lever 16 presses the yarn ends YB and YP to such an extent that the positions of the yarn ends YB and YP are regulated.

Figure 13:
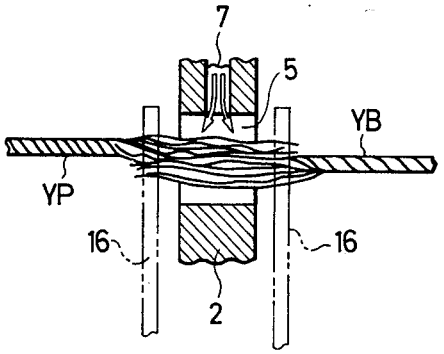
FIG. 13 is an enlarged view of yarn ends, which illustrates the splicing operation.

By the actions of the yarn gathering levers 33 and yarn pressing levers 16, the yarn ends YB and YP sucked in the sleeves 47 of the control nozzles 24 and 25 are attracted into the splicing hole 5 of the splicing member 2 and positioned therein, and both the yarn ends YB and YP are set in the state where the yarn ends to be spliced are overlapped to each other as shown in FIG. 13. At this time, the length of the joint to be formed by splicing is determined by the turning distances of the yarn gathering levers 33 and yarn pressing levers 16. Therefore, the turning distances of the yarn gathering levers 33 and yarn pressing levers 16 are adjusted according to the count number of the yarn.

By the turning operations of the yarn gathering levers 33, the yarn ends YB and YP drawn out by the sleeves of the control nozzles 24 and 25 are taken out while being controlled by the control plates 12 and 13 arranged on both the sides of the splicing hole 5, and positioning of the yarn ends YB and YP on the inner circumferential face of the splicing hole 5 is performed by the side edges of the control plates 12 and 13 and the side edges of the yarn pressing levers 16 and the yarn ends YB and YP to be spliced are set in the contacted and overlapped state in the splicing hole 5.

In the state where the yarn ends YB and YP are thus set in the splicing hole 5, splicing is accomplished by the action of the compressed fluid jetted from the jet nozzle 7. At this time, fibers of both the overlapped yarn ends are entangled and integrated by air jetted from the jet nozzle 7 and the entangled fibers are then turned, and both the yarn ends are integrated and twisted and entanglements are given on both the sides of the twists. Since the control nozzles do not perform the sucking action any longer, no restriction is given to the untwisted and disentangled top portions of the yarn ends and splicing is accomplished without formation of a horny portion.

When the above-mentioned splicing operation is completed, the yarn gathering levers 33 and yarn pressing levers 16 separate from the yarns YB and YP, and the yarns YB and YP pass through the slit 6 of the splicing member 2 and the normal rewinding state is restored.

As will be apparent from the foregoing description, in the apparatus of the present invention, a cylindrical sleeve is arranged in a control nozzle for sucking the yarn ends and untwisting the yarn ends by jetting a compressed fluid to the yarn ends at the splicing operation, so that the sleeve can slide in the axial direction of the control nozzle, and a jet nozzle is arranged on the sleeve to extend to the interior of the sleeve. Therefore, by appropriately sliding the sleeve in the control nozzle according to the length of yarn ends and the kind of fibers, the position of impingement of the jet stream against the yarn can properly be changed and a knob-free smooth joint can be formed.

What is claimed is:

1. An apparatus for splicing spun yarns, which comprises a splicing member having a splicing hole and a jet nozzle for jetting a compressed fluid into said splicing hole, and control nozzles arranged on both the outer sides of said splicing hole to suck yarn ends to be spliced, said splicing apparatus being characterized in that a cylindrical sleeve having an inclined jet hole formed on the tubular wall thereof to extend to the interior of the cylinder and to be communicated with an air introducing hole is fitted in a nozzle hole of said control nozzle slidably in the axial direction thereof so that the position of the jet hole relative to the yarn ends can appropriately be changed.

2. An apparatus for splicing spun yarns as claimed in claim 1, wherein the position of the inclined jet hole of the cylindrical sleeve is determined so that the upper end of the sleeve does not project from the upper end of the control nozzle when the sleeve is located at the most advanced position within the control nozzle.

3. An apparatus for splicing spun yarns as claimed in claim 1, wherein the jetting direction of said inclined jet hole is adjusted according to the twisting direction of the yarn to be untwisted and to be spliced.

* * * * *